US007976138B2

(12) United States Patent
Kucmerowski et al.

(10) Patent No.: US 7,976,138 B2
(45) Date of Patent: Jul. 12, 2011

(54) DATA-PROVIDING-COMPONENT SECURING MECHANISM FOR PRINTING APPARATUS RESERVOIR

(75) Inventors: Douglas E. Kucmerowski, Brockport, NY (US); Kevin R. Barrell, Hilton, NY (US); Eugene Edwards, Pittsford, NY (US); Mark D. Perkins, Wayland, NY (US)

(73) Assignee: Eastman Kodak Company, Rochester, NY (US)

( * ) Notice: Subject to any disclaimer, the term of this patent is extended or adjusted under 35 U.S.C. 154(b) by 1105 days.

(21) Appl. No.: 11/614,107

(22) Filed: Dec. 21, 2006

(65) Prior Publication Data

US 2008/0151012 A1 Jun. 26, 2008

(51) Int. Cl.
*B41J 2/175* (2006.01)
*B41J 2/195* (2006.01)

(52) U.S. Cl. ..... 347/85; 347/7

(58) Field of Classification Search ..... 347/37, 347/85, 104, 108, 7, 86; 439/296, 325
See application file for complete search history.

(56) References Cited

U.S. PATENT DOCUMENTS

| | | | | |
|---|---|---|---|---|
| 4,838,804 | A * | 6/1989 | Banjo et al. | 439/325 |
| 6,499,826 | B1 * | 12/2002 | Kline et al. | 347/37 |
| 6,588,871 | B2 * | 7/2003 | Studholme et al. | 347/19 |
| 6,702,427 | B2 | 3/2004 | Shimizu et al. | 347/50 |
| 6,851,799 | B2 | 2/2005 | Trafton et al. | 347/86 |
| 7,690,774 | B2 | 4/2010 | Petranek et al. | |
| 2002/0033857 | A1 | 3/2002 | Ohashi et al. | |
| 2004/0104954 | A1 * | 6/2004 | Ito | 347/20 |
| 2004/0181681 | A1 * | 9/2004 | Salisbury | 713/200 |
| 2006/0053030 | A1 | 3/2006 | Nakamura et al. | |
| 2006/0152561 | A1 | 7/2006 | Belfiore et al. | |

FOREIGN PATENT DOCUMENTS

| | | |
|---|---|---|
| EP | 1 454 752 | 9/2004 |
| EP | 1 854 632 | 11/2007 |
| WO | 02/11986 | 2/2002 |

* cited by examiner

*Primary Examiner* — Stephen D Meier
*Assistant Examiner* — Geoffrey Mruk
(74) *Attorney, Agent, or Firm* — Justin D. Petruzzelli; David A. Novais; Eugene I. Shkurko

(57) ABSTRACT

The present invention pertains to a data-providing component securing mechanism for a printing apparatus reservoir. According to embodiments of the present invention, a securing mechanism is provided with an image-formation-material reservoir. The securing mechanism includes a drawer-style support feature having two guiding regions that interact with sides of the data-providing component when it is inserted therein. Upon complete or substantially complete insertion of the data-providing component into the drawer-style support feature, a retention feature is engaged at an opening end of the drawer-style support feature in order to retain the data-providing component in its engaged position. Consequently, the data-providing component can be secured without the use of external bonding agents, and can be removed from the drawer-style support feature intact, thereby allowing such data-providing component to be reused.

27 Claims, 5 Drawing Sheets

DATA-PROVIDING-COMPONENT SECURING MECHANISM FOR PRINTING APPARATUS RESERVOIR

FIELD OF THE INVENTION

This invention relates to a data-providing-component securing mechanism for a printing apparatus' image-formation-material reservoir. In particular, the present invention pertains to a drawer-style support feature of a securing mechanism configured to retain a data-providing component on or in an image-formation-material reservoir.

BACKGROUND OF THE INVENTION

Conventional ink jet printing technologies use printheads that have nozzles that eject ink onto a substrate. The ink is provided from one or more ink tanks communicatively connected to the printhead. A challenge in the ink jet printing industry has been to accurately determine when ink has been depleted or is about to be depleted from an ink tank. One conventional solution to this problem has been to attach a data storage device, such as a computer-accessible memory, commonly referred to as a "smartchip," to the ink tanks. The smartchip stores information relating to an amount of ink remaining in the ink tank. As ink droplets are transferred from the ink tank to the printhead and expelled onto the substrate (or are consumed by maintenance operations), a number stored in the smartchip representing the remaining amount of ink is decreased. Alternatively, a number stored in the smartchip representing the amount of ink that has been used (starting from a known initial amount) is increased. In either case, the information is related to an amount of ink remaining in the ink tank. In this way, the information stored by the smartchip may be used to predict when the ink tank will run out of ink.

A smartchip may consist of an integrated circuit chip which is encapsulated such that electrical contacts are provided on one surface. These smartchips have conventionally been manufactured as stand-alone devices without any independent means for attaching them to other devices. Accordingly, some conventional techniques for securing a smartchip to an ink tank 102 have involved the use of adhesives, as shown in FIG. 1. For example, an ink tank 102 has a smartchip 106 attached thereto with an epoxy-dot adhesive 110. In other words, in order to bond the smartchip 106 to the ink tank 102, a machine applies dots of an epoxy adhesive 110 to seams between the smartchip 106 and the ink tank 102 in order to bond the smartchip 106 to the ink tank 102. In these conventional arrangements, solder may be used in place of the epoxy adhesive 110. Another conventional scheme involves applying an adhesive tape or backing 112 on a back side of a smartchip 108. The smartchip 108 with the adhesive tape/backing 112 is then pressed onto the ink tank 104 in order to adhere it thereto.

Shortcomings of these conventional techniques include the use of too little adhesive, which causes poor adhesion. In this case, a risk exists that the smartchip 106, 108 may become dislodged from the ink tank 102, 104 respectively. Alternatively, especially in the case of epoxy dot adhesion 110, too much adhesive may be used. In this case, a risk exists that the adhesive 110 may cover contacts 107 on the smartchip 106. An additional shortcoming of these conventional techniques is that the adhesive may permanently attach the smartchip 106, 108 to the ink tank 102, 104, respectively, especially in the case of too much adhesive or solder being used. In this case, the smartchip 106, 108 may be damaged if detached from the ink tank 102, 104, respectively. This case may be troublesome when ink tanks 102, 104 are recycled and the smartchip 106, 108 is desired to be reused for another device. An additional shortcoming, especially in the case of the pressure backed adhesive 112, is that pressure must be applied to the smartchip 108 in order to attach it to the ink tank 104. In this case, a risk exists that such pressure may damage the smartchip 108.

Accordingly, a need in the art exists for a solution to attaching a smartchip to an ink tank that reduces one or more of the shortcomings described above.

SUMMARY OF THE INVENTION

The above-described problems are addressed and a technical solution is achieved in the art by a data-providing-component securing mechanism for a printing apparatus reservoir, according to embodiments of the present invention. According to an embodiment of the present invention, a securing mechanism with a drawer-style support feature is provided for the printing apparatus reservoir. According to an embodiment of the present invention, the printing apparatus reservoir is an image-formation-material ("IFM") reservoir, such as an ink reservoir or a toner reservoir. According to an embodiment of the present invention, the securing mechanism has a retention feature at an opening end of the drawer-style support feature. The drawer-style support feature of the securing mechanism is configured to receive a data-providing component, such as a data storage device (e.g., a smartchip) or an RFID, that is communicatively connected to a data processing system and facilitates at least monitoring of an operation of the reservoir. Consequently, according to embodiments of the present invention, the data-providing component may be securely attached to the reservoir without the use of an external bonding agent. However, external bonding agents could be used in conjunction with the securing mechanisms of embodiments of the present invention. Further, a low risk of damage to the data-providing component exists, according to embodiments of the present invention, because the data-providing component is slid into the drawer-style support feature of the securing mechanism with pressure applied to a side of the data-providing component, as opposed to a top surface thereof. Additionally, according to embodiments of the present invention where re-use of the data-providing component is desired, the data-providing component may easily be removed from the securing mechanism without damage because no adhesive or no permanent adhesive is used.

According to an embodiment of the present invention, the retention feature at the opening end of the drawer-style support feature of the securing mechanism is an engaging retention feature, such as a lip or a hook. According to another embodiment of the present invention, the retention feature includes more than one lip or hook, such as two staked ends molded to wrap around an end of the data-providing component installed in the drawer-style support feature of the securing mechanism.

In addition to the embodiments described above, further embodiments will become apparent by reference to the drawings and by study of the following detailed description.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale.

DETAILED DESCRIPTION

Embodiments of the present invention provide a printing apparatus reservoir, such as an image-formation-material ("IFM") reservoir, with a securing mechanism having a drawer-style support feature. The drawer-style support feature, according to an embodiment of the present invention, includes two guiding regions that interact with opposing sides of a data-providing component when such data-providing component is slid into the drawer-style support feature. Upon installation of the data-providing component, a retention feature is located at an opening end of the drawer-style support feature that retains the data-providing component in its engaged position. Accordingly, the data-providing component may be secured to the IFM reservoir without the use of an external bonding agent, such as solder or adhesive. In addition, little or no risk of damage to the data-providing component exists by the installation techniques according to various embodiments of the present invention. Consequently, the data-providing components can be removed from the drawer-style support and reused for subsequent applications. Since such data-providing components often are a substantial cost associated with manufacturing printing apparatuses, significant cost savings may be obtained by reusing such data-providing components upon expiration of an IFM reservoir.

According to embodiments of the present invention, the IFM reservoir is an single color ink tank or a multi-color ink tank for use in an ink jet printing apparatus. However, one skilled in the art will appreciate that the techniques used herein may be applicable to securing a data-providing component to other types of printing apparatuses and even other types of apparatuses generally. So long as a data-providing component needs to be easily and reliably secured to a component, the techniques described herein may be advantageous.

According to an embodiment of the present invention, the data-providing component is a smartchip, such as a data storage device integrated circuit. However, one skilled in the art will appreciate that other types of components may be used, such as radio-frequency ID ("RFID") chips.

Figure 1:
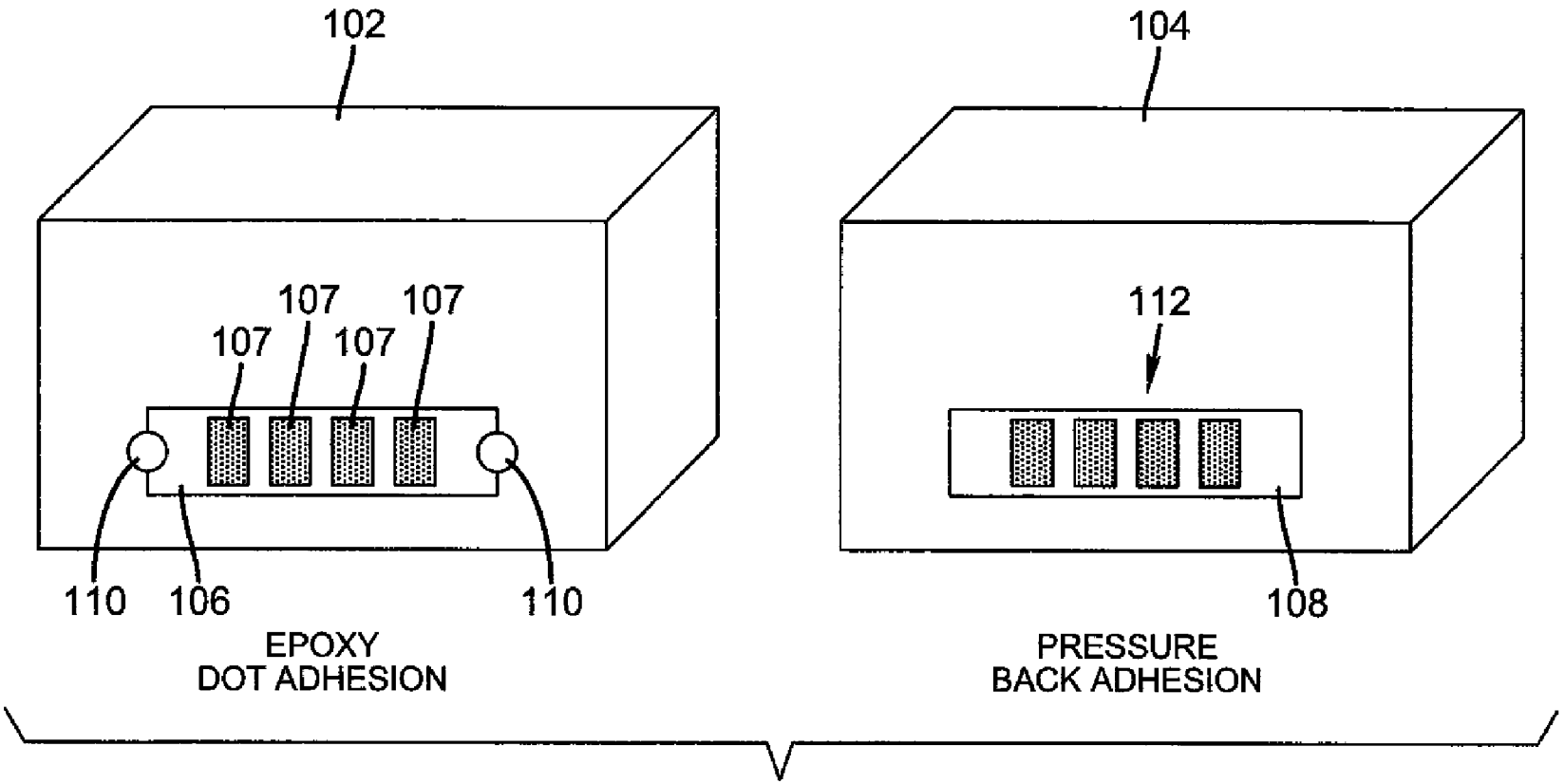
FIG. 1 illustrates conventional smartchip adhesion techniques.
Figure 2:
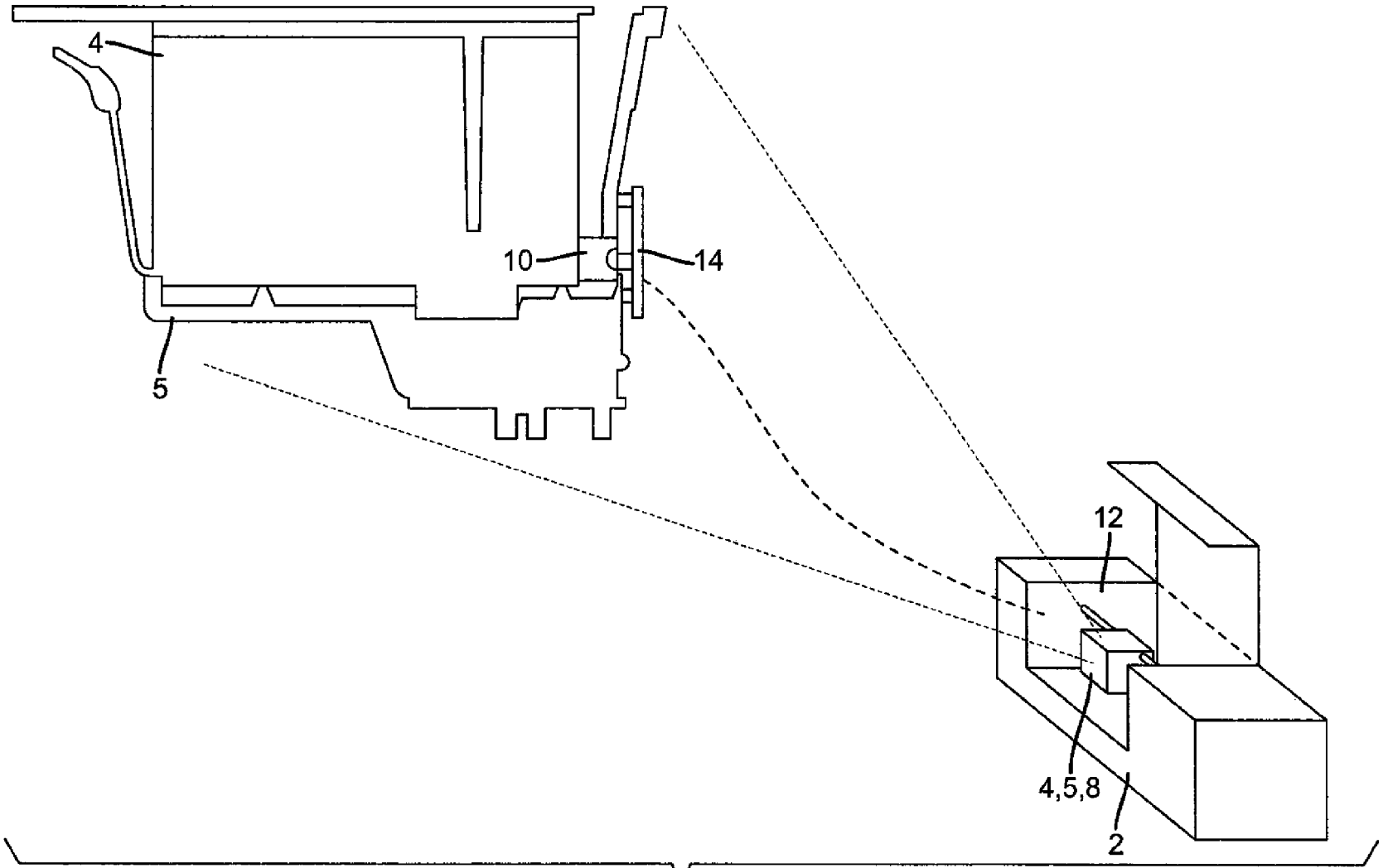
FIG. 2 illustrates a printing apparatus utilizing a securing mechanism, according to an embodiment of the present invention.

FIG. 2 illustrates a printing apparatus 2 having an image-formation-material ("IFM") reservoir 4 installed therein, according to an embodiment of the present invention. The IFM reservoir 4 may be an ink tank formed of polypropylene used in an ink jet printing apparatus, according to an embodiment of the present invention. While polypropylene is an advantageous material for forming an IFM reservoir 4 because of its cleanliness and compatibility with inks, one skilled in the art will appreciate that many other injection-moldable materials may be used to form the IFM reservoir 4.

In the case of the IFM reservoir 4 being an ink tank, the printing apparatus 2 may be an ink jet printer. However, one skilled in the art will appreciate that the printing apparatus 2 may be another type of printing apparatus, such as an electrophotographic printing apparatus, and the IFM reservoir 4 may include other image-formation-materials besides ink, such as toner for an electrophotographic printing apparatus.

According to the embodiment of FIG. 2, the IFM reservoir 4 is supported by a printhead chassis 5. The printhead chassis 5 and the IFM reservoir 4 are mounted on a carriage assembly 8 which moves in a lateral direction as image-forming-material is ejected to form an image on a substrate. Also according to this embodiment, a component, such as a data-providing component 6 is retained by a securing mechanism 10. The data-providing component 6 is communicatively connected (via connector 14 on the carriage and a communicative connection represented by the curved dotted line) to a data processing system 12. Data processing system 12 is typically located within the body of the printing apparatus 2, and it interacts with the data-providing component 6 in order to at least monitor an operation of the IFM reservoir 4, according to an embodiment of the invention. The phrase "communicatively connected" is intended to include any type of connection, whether wired, wireless, or both, between devices, and/or data processing systems, and/or programs in which data may be communicated.

Figure 3:
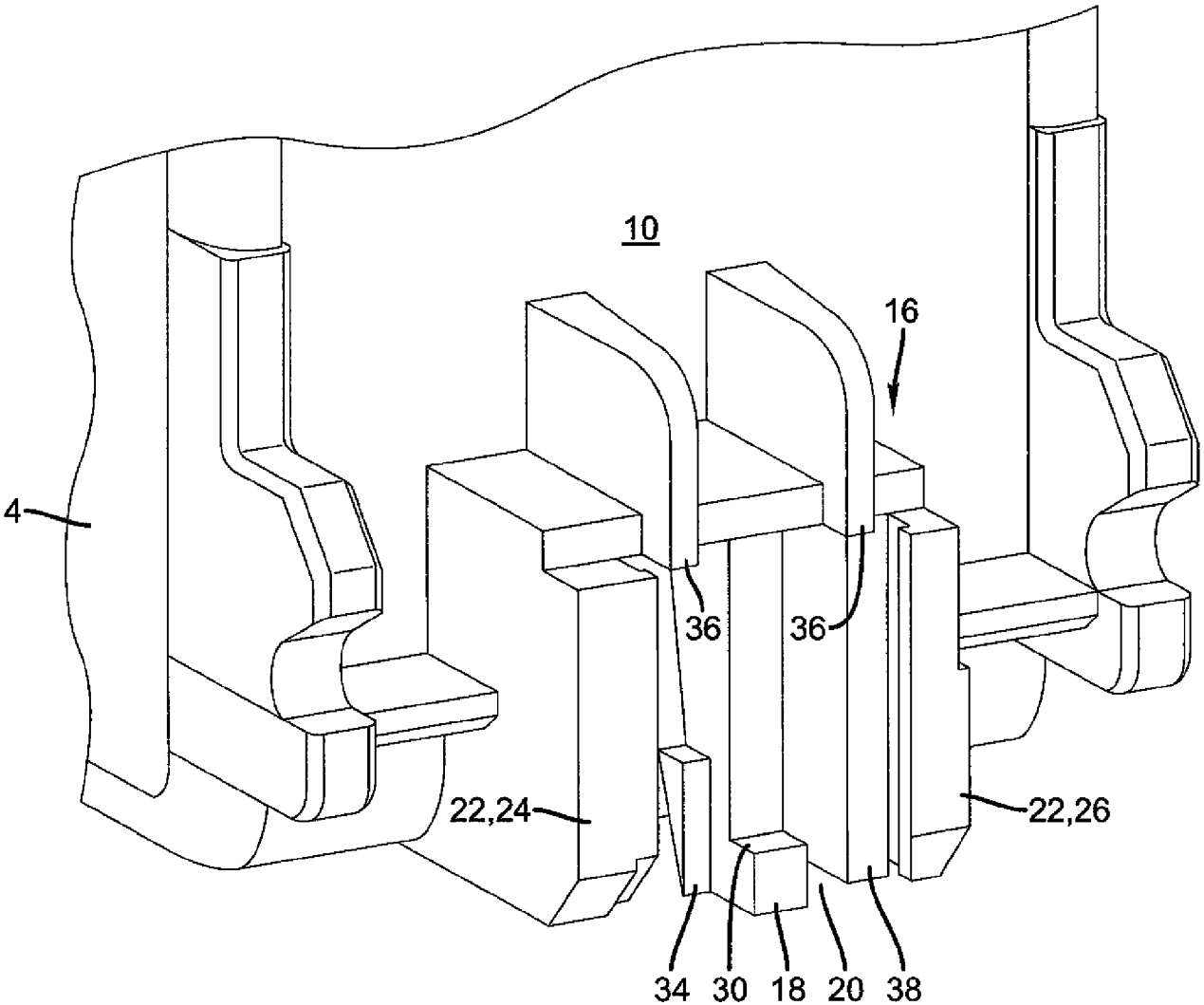
FIG. 3 illustrates an engaging retention feature at an opening end of a drawer-style support feature of a securing mechanism prior to data-providing-component installation, according to an embodiment of the present invention.

FIG. 3 illustrates a close view of a securing mechanism 10 integrally formed with the IFM reservoir 4, according to an embodiment of the present invention. For example, securing mechanism 10 may be formed during the same injection molding process as is used to fabricate the IFM reservoir 4. Although the securing mechanism 10 is integrally formed with the IFM reservoir 4 in FIG. 3, one skilled in the art will appreciate that the securing mechanism 10 may instead be its own separate part attached to the IFM reservoir 4.

Figure 4:
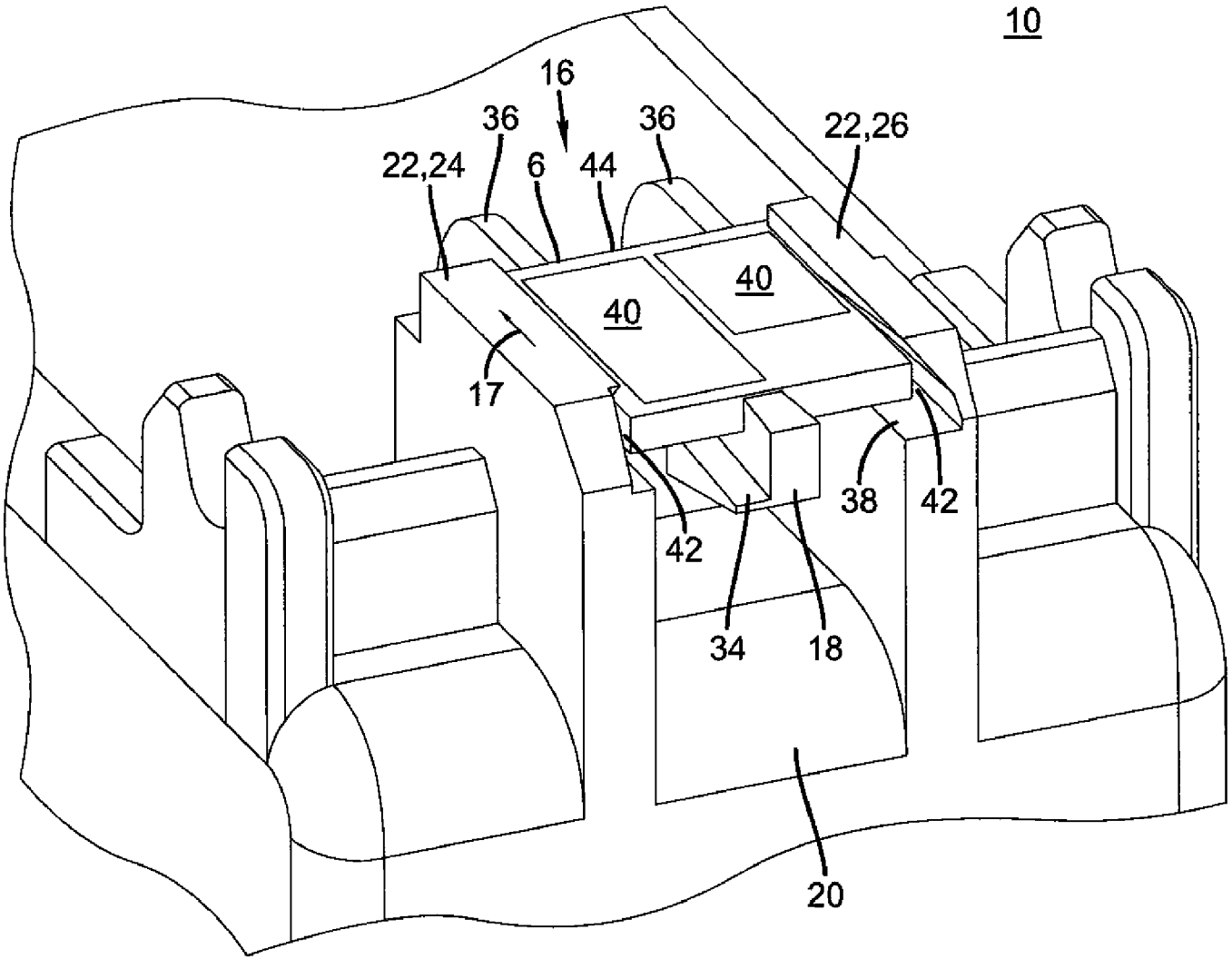
FIG. 4 illustrates an engaging retention feature at an opening end of a drawer-style support feature of a securing mechanism after a data-providing component has been installed therein, according to an embodiment of the present invention.

According to the embodiment of FIG. 4, the securing mechanism 10 includes a drawer-style support feature 16. The drawer-style support feature 16 includes a base surface 38 that supports an underneath of the data-providing component 6 (shown in FIG. 4). The drawer-style support feature 16 also includes two guiding regions 22 that interact with sides 42 of the data processing component 6 when such component 6 is inserted into the securing mechanism 10 in a direction 17. According to this embodiment, the guiding regions 22 include a fixed wall 24 and a spring wall 26. The spring wall 26 biases the data-providing component 6 against the fixed wall 24. According to an embodiment of the present invention, the spring wall 26 has a dove tail shape.

Upon complete installation of the data-providing component 6 into the drawer-style support feature 16, stop datums 36 contact an end of the data-providing component 6 and prevent it from moving any further into the securing mechanism 10. In this position, a retention feature 18 located at an opening end 20 of the drawer-style support feature 16 hooks around an end of the data-providing component 6 to lock such component 6 into its engaged position. According to this embodiment, the retention feature 18 is an engaging retention feature, such as a lip or hook 30.

FIG. 4 illustrates the embodiment of FIG. 3 with the data-providing component 6 installed into the securing mechanism 10. As shown in FIG. 4, the data-providing component has data contact pads 40 thereon that are used to form a communicative connection between the data providing component 6 and the data processing system 12 (not shown in FIG. 4). Also shown in FIG. 4 are the sides 42 of the data-providing component 6 that interact with the guiding regions 22 of the securing mechanism 10. According to this embodiment, an end 44 of the data providing component 6 interacts with the stop datums 36.

As shown in the embodiment of FIGS. 3 and 4, the securing mechanism 10 includes a release mechanism 34 that, upon application of a depression force, releases the data-providing component 6 from the securing mechanism 10 unharmed. Consequently, the data-providing component 6 may be reused upon removal from the securing mechanism 10.

The securing mechanism 10, illustrated in the embodiment of FIGS. 3 and 4 may be used without an external bonding agent. In other words, the securing mechanism 10 can retain the data-providing component 6 in a mechanical manner, without external bonding agents, such as adhesive or solder. In this regard, the securing mechanism 10 may include a release mechanism 34 that, upon application of a depression force, releases the data-providing component 6 from the securing mechanism 10 unharmed. Consequently, the data-providing component 6 may be reused upon removal from the securing mechanism 10. In addition, if re-use of the data-providing component 6 is desired and use of an external bonding agent also is desired, a non-permanent adhesive, i.e., an adhesive that may be removed and does not damage the data providing component 6 or hinder its operability or use, may be used. In this regard, if re-use of the data-providing component 6 is not desired, nearly any external bonding agent may be used in addition to the securing mechanism 10.

Figure 5:
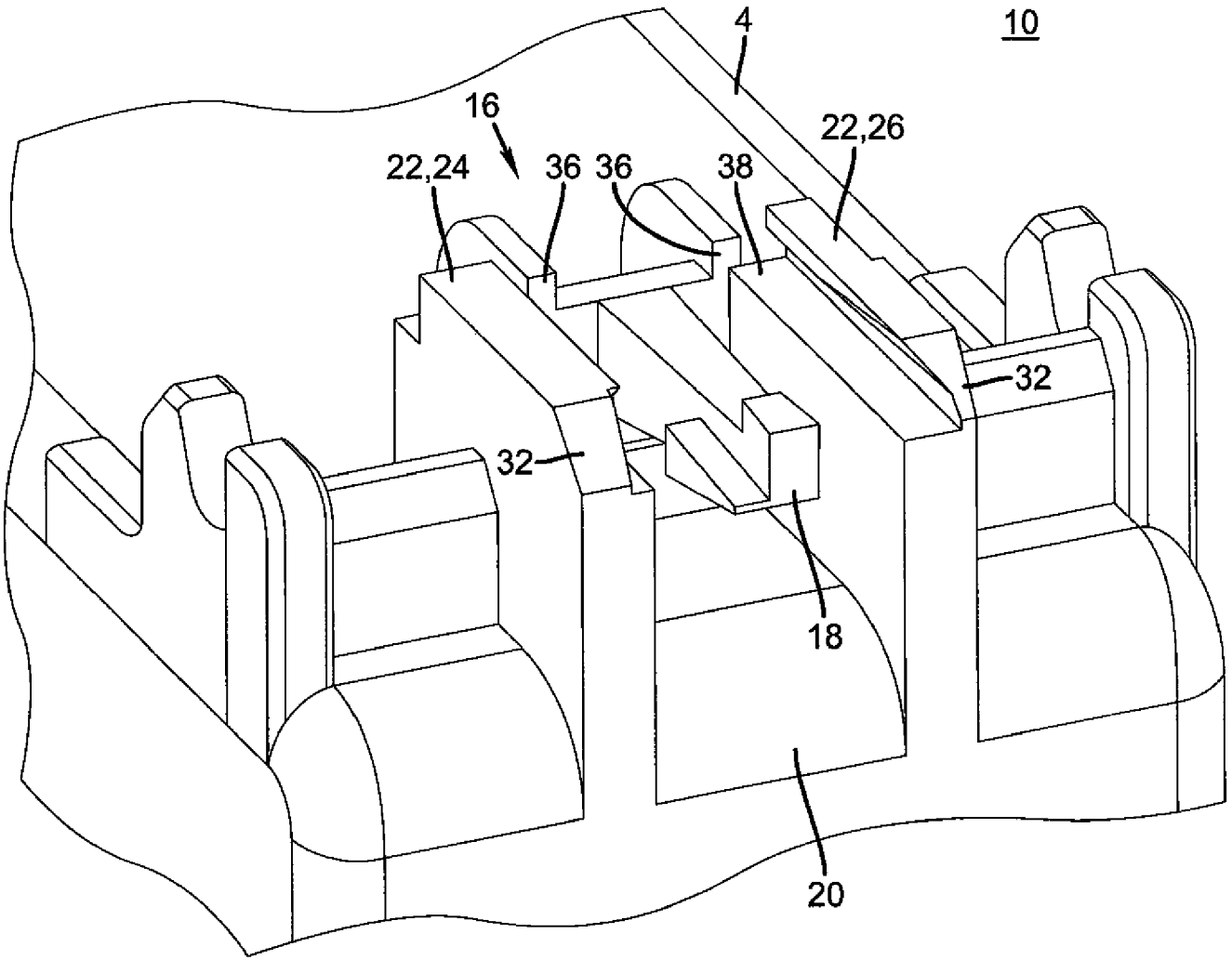
FIG. 5 illustrates a retention feature of an opening end of a drawer-style support feature of a securing mechanism, according to another embodiment of the present invention.

FIG. 5 illustrates a drawer-style support feature 16 of a securing mechanism 10 integrally formed with the IFM reservoir 4, according to another embodiment of the present invention. Although the securing mechanism 10 is integrally formed with the IFM reservoir 4 in FIG. 5, one skilled in the art will appreciate that the securing mechanism 10 may instead be its own separate part attached to the IFM reservoir 4.

According to the embodiment of FIG. 5, the retention feature 18 at an opening end 20 of the drawer-style support feature 16 includes staked ends 32. The staked ends 32 form lips or hooks that wrap around the end of the data providing component 6 (not shown in FIG. 5). The staked ends may be molded into their staked position by heat and/or pressure after the data-providing component is inserted therein. In order to reduce risk of damage to the data-providing component 6 when staking the ends 32, the securing mechanism 10 may be formed of a material that is moldable at a low temperature, such as polypropylene. According to this embodiment, in order to remove the data-providing component 6 from the securing mechanism 10, the staked ends 32 may be reheated and opened to allow the data-providing component 6 to be removed from the drawer-style support feature 16 unharmed. Although, according to this embodiment, heating is referred to as a mechanism for molding the staked ends 32, one skilled in the art will appreciate that other techniques, such as cold staking or merely the application of pressure for molding a material, may be used.

It is to be understood that the exemplary embodiments are merely illustrative of the present invention and that many variations of the above-described embodiments can be devised by one skilled in art without departing from the scope of the invention. It is therefore intended that all such variations be included within the scope of the following claims and their equivalents.

PARTS LIST

2 Printing apparatus
4 Image-formation-material ("IFM") reservoir
5 Printhead chassis
6 Component (RFID, smartchip) data storage device
8 Carriage assembly
10 Securing mechanism
12 Data processing system
14 Communicative connection between processing system and data storage device
16 Drawer-style support feature of securing mechanism
17 Insertion Direction
18 Engaging retention feature
20 Opening end of drawer-style support feature
22 Two guiding regions of securing mechanism
24 Fixed wall of securing mechanism
26 Spring wall of securing mechanism
30 Hook at end of securing mechanism
32 Lip at end of securing mechanism
34 Release mechanism of securing mechanism
36 Stop datum
38 Base surface
40 Data contact pads
42 Sides of component, interact with securing mechanism
44 End of component
102, 104 Ink tank
106, 108 Smartchip
110 Epoxy dot adhesive
112 Adhesive tape backing

What is claimed is:

1. An image-formation-material ("IFM") reservoir comprising:

a securing mechanism integrally formed with the IFM reservoir, the securing mechanism configured to secure a data-providing component, the data-providing component comprising first and second sides opposite each other and third and fourth sides opposite each other, and configured to provide information to a data processing system about the IFM reservoir to facilitate monitoring the IFM reservoir by the data processing system, the securing mechanism comprising:

a support configured to retain the data-providing component, the support comprising two opposing guiding regions each configured to secure the first and second sides of the data-providing component when the data-providing component is inserted into the support;

a stop datum contacting the third side of the data-providing component to prevent the data-providing component from moving further when the data-providing component is inserted into the support; and an engaging retention feature disposed at the fourth side of the data-providing component when the data-providing component is inserted into the support for preventing the data-providing component from withdrawing from the securing mechanism.

2. The IFM reservoir of claim 1, wherein the securing mechanism is without an external bonding agent.

3. The securing mechanism of claim 1, wherein the securing mechanism is configured to secure the data-providing component to the IFM reservoir without solder or adhesive.

4. The IFM reservoir of claim 1, wherein the securing mechanism is configured to allow the data-providing component to be withdrawn from the securing mechanism without damage.

5. The IFM reservoir of claim 1, wherein the engaging retention feature comprises a lip or hook.

6. The IFM reservoir of claim 5, wherein the engaging retention feature comprises an injection moldable material.

7. The IFM reservoir of claim 6, wherein the engaging retention feature comprises polypropylene.

8. The IFM reservoir of claim 1, further comprising a flexible release mechanism configured to release the data-providing component upon flexing the release mechanism.

9. The IFM reservoir of claim 1, further comprising a release mechanism configured to release the data-providing component upon a depression of the release mechanism.

10. The printing apparatus of claim 1, wherein the data-providing component comprises an integrated circuit chip.

11. The printing apparatus of claim 1, wherein the data-providing component comprises a radio-frequency ID chip.

12. The IFM reservoir of claim 1 wherein one of the two guiding regions comprises a fixed wall fixed in position, and wherein an other of the two guiding regions comprises a spring wall for biasing the data-providing component against the fixed wall.

13. The IFM reservoir of claim 12, wherein the spring wall comprises a dovetail-shaped spring wall.

14. A printing apparatus comprising:

an image-formation-material ("IFM") reservoir, the IFM reservoir comprising a securing mechanism for receiving a reusable data-providing component, wherein the data-providing component comprises first and second sides opposite each other and third and fourth sides opposite each other, and wherein the securing mechanism comprises (a) a support for retaining the data-providing component and (b) a stop datum engaging the third side of the data-providing component, and (c) an engaging retention feature disposed at the fourth side of the data-providing component for preventing unintentional withdrawal of the data-providing component when the data-providing component is engaged into the securing mechanism;

a data processing system communicatively connected to the data-providing component, the data processing system configured to receive data from the data-providing component about the IFM reservoir;

wherein the support comprises two guiding regions, and wherein the first and second sides of the data providing component interact with the guiding regions; and wherein one of the two guiding regions comprises a fixed wall fixed in position, and wherein an other of the two guiding regions comprises a spring wall for biasing the data-providing component against the fixed wall.

15. The printing apparatus of claim 14, wherein the data defines an amount of image-formation material remaining in the reservoir.

16. The printing apparatus of claim 14, wherein the securing mechanism secures the data-providing component to the IFM reservoir without an external bonding agent.

17. The printing apparatus of claim 14, wherein the securing mechanism secures the data-providing component to the IFM reservoir without solder or adhesive.

18. The printing apparatus of claim 14, wherein at least one of the guiding regions comprises a dovetail shape.

19. The printing apparatus of claim 14, wherein the securing mechanism secures the data-providing component to the IFM reservoir in a manner that allows the data-providing component to be re-used if removed from the securing mechanism.

20. The printing apparatus of claim 14, wherein the engaging retention feature comprises a lip or hook.

21. The printing apparatus of claim 20, wherein the engaging retention feature comprises staked ends.

22. The printing apparatus of claim 21, wherein the staked ends comprise an injection moldable material.

23. The printing apparatus of claim 22, wherein the staked ends comprise polypropylene.

24. The printing apparatus of claim 14, wherein the securing mechanism is formed integrally with the IFM reservoir.

25. The printing apparatus of claim 14, wherein the securing mechanism comprises a flexible release mechanism configured to release the data-providing component upon flexing the release mechanism.

26. The printing apparatus of claim 25, wherein the release mechanism is configured to release the data-providing component upon a depression of the release mechanism.

27. The printing apparatus of claim 14, wherein the IFM reservoir is an ink tank and the printing apparatus is an ink-jet printing apparatus.

* * * * *